US005913723A

United States Patent [19]

Ribo

[11] Patent Number: 5,913,723

[45] **Date of Patent: *Jun. 22, 1999**

[54] PROCESS AND APPARATUS FOR AIR CONDITIONING AND/OR HEATING, ESPECIALLY FOR APARTMENT BUILDINGS

[76] Inventor: Robert Ribo, Domaine de 1'Obit, 11400 Verdun-En-Lauragais, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/532,682

[22] PCT Filed: Mar. 31, 1994

[86] PCT No.: PCT/FR94/00363

§ 371 Date: Mar. 4, 1996

§ 102(e) Date: Mar. 4, 1996

[87] PCT Pub. No.: WO94/23249

PCT Pub. Date: Oct. 13, 1994

[30] Foreign Application Priority Data

Apr. 6, 1993 [FR] France ..... 93 04160

[51] Int. Cl.[6] ..... F24F 1/00

[52] U.S. Cl. ..... 454/233; 62/89; 62/186; 236/49.3; 454/258

[58] Field of Search ..... 62/186, 178, 179, 62/408, 417, 441, 89, 229; 454/256, 258, 229, 233; 236/49.3

[56] References Cited

U.S. PATENT DOCUMENTS

| | | | |
|---|---|---|---|
| 2,350,886 | 6/1944 | Friemann . | |
| 3,267,995 | 8/1966 | Maudlin . | |
| 5,279,609 | 1/1994 | Meckler | 236/49.3 |
| 5,535,814 | 7/1996 | Hartman | 236/49.3 X |
| 5,545,086 | 8/1996 | Sharp et al. | 454/229 X |

*Primary Examiner*—Henry A. Bennett
*Assistant Examiner*—Susanne C. Tinker
*Attorney, Agent, or Firm*—Harold H. Dutton, Jr.

[57] ABSTRACT

A domestic air conditioning and/or heating method, particularly for apartment buildings, using an outside unit (2) and an inside unit (1) connected to one another via fluid and electrical lines (3). The outside unit (2) includes a compressor, a ventilation system and an exchanger while the inside unit (1) includes a ventilation system and an exchanger. A low pressure inside unit (1) supplies pressurized air at a pressure no higher than 8 mm and the air is bulk-fed into a false ceiling (6) forming a decompression chamber and comprises supply grills (15–17) for blowing air into each of the rooms to be served.

11 Claims, 2 Drawing Sheets

PROCESS AND APPARATUS FOR AIR CONDITIONING AND/OR HEATING, ESPECIALLY FOR APARTMENT BUILDINGS

BACKGROUND AND OBJECTS OF THE INVENTION

This invention relates to a process and apparatus for air conditioning and/or heating of buildings, in particular apartment buildings.

Apparatus able to permit air conditioning and heating of buildings are of four types, being differentiated by the source of external energy, air or water, used, and by the fluid, air or water, used to restore this energy into the buildings.

The first type of apparatus comprises air/water systems generally comprised of a central installation made up of a exterior unit installed on the terrace, and ventilator-convectors arranged in the apartments to be heated and cooled, and fed from the exterior unit by means of insulated fluid conduits.

Other than their high price, such installations have several drawbacks. In the first place, they impose a certain pre-installation of the apparatus without determining whether the occupants do or do not desire the air conditioning option. Moreover, they require the installation of an energy metering system responding to specific standards, the cost of which has become relatively high. Further, such installations present a problem of flexibility when, in mid-season, certain well exposed locations require being cooled, while others locations require being heated. It will be noted that this latter problem may be resolved by installing two external units, one per face, south and north. However, this solution leads to a not inconsequential excess investment cost. Finally, all failures of the exterior group have as a consequence to cause all of the apartments in the building to go without the heating or air conditioning.

The second type of apparatus comprises water/air systems made up of heat pumps arranged in the buildings, and fed by means of a loop of constant temperature water, maintained at the desired temperature by a heater for the loop and a cooling tower serving for the evaporation of 15% of the water of the circuit for cooling the same.

This system permits overcoming certain of the drawbacks of the air/water systems described above. In effect, it is possible to heat or cool at the same time the different apartments in the building. Moreover, in the event of failure of one of the elements of the cooling tower, the operating failure affects only one apartment and not the entire building. On the other hand, this system also has drawbacks. In the first place, the noise level in the apartments is high because the compressors are installed inside the heat pumps which are installed in the apartments. Moreover, while the pre-installation is less costly in the case of an air/water system (less expensive cooling tower than the exterior unit of this air/water system, and non-insulated tubing) the overall cost of the installation is greater than that of the air/water systems.

The third type of apparatus comprises water/water systems made up of ventilator-convectors arranged in the apartments, and fed by means of a water loop provided with a cooling tower. Such a system may be compared to air/water systems with the additional drawback of not permitting reversal of the cycle.

Finally, the fourth type of apparatus comprises air/air systems provided by means of split systems, that is apparatus including the condenser part and the evaporator part, and comprising an exterior unit and an interior unit connected by a "Freon" conduit, the exterior unit comprising a fan, a compressor and a heat exchanger, and the interior unit comprising a fan and a heat exchanger.

Such split systems may be designed for treating the entire building. The interior unit is then connected to a network of ducts permitting distribution of the air to the different units of this building. Such a system has for an advantage being of a lower cost with respect to the three aforementioned systems. Moreover, the different units are treated in a completely independent manner. On the other hand, the cost price of the systems remains relatively high. Further, the noise level at the air return of the interior unit is high. Finally, the control of the temperature in the different units is very uncertain.

These split systems may also be used in an individual manner, by installing one apparatus per unit. This solution offers a great flexibility of use, but its cost is high.

DESCRIPTION OF THE INVENTION

The present invention seeks to overcome the drawbacks of the above-described air conditioning and heating systems for buildings, and has as its primary object to provide an apparatus for air conditioning and/or heating comprised of an air/air system of low cost price and noise level, and permitting treatment of the apartments in an individual manner.

To this end, the invention provides a process for air conditioning and/or heating buildings, especially apartment buildings, of the type comprising:

- using an exterior unit and an interior unit connected by fluid and electrical connections, the exterior unit comprising a compressor, ventilation means and a heat exchanger, the interior unit comprising ventilation means and an exchanger,
- providing a circulation of air on the interior of the building with the help of the ventilation means of the interior unit, and
- carrying out the operation of the compressor of the exterior unit with a member for controlling the temperature of the interior of the apartment determining the temperature ordered.

According to the invention, this process is characterized in that it comprises:

- using a low pressure interior unit able to deliver air under a pressure at most equal to 8 mm, and
- delivering this air in bulk through a false ceiling forming a sealed plenum able to serve as an expansion chamber, said plenum comprising blower grilles opening into each of the units to be treated.

According to this process, one assures the air conditioning of a building comprising several units by means of an interior unit/exterior unit set designed for treating a single unit (blower opening downstream by reason of the low pressure of the interior apparatus).

As a result, it is in particular possible according to the process of the invention, to air condition an apartment building with a relatively low floor area but comprising several units, by using an assembly designed originally to air condition only a single unit.

This air conditioning is, in addition, assured by means of an installation not including any blowing duct, and of which the noise level is only very slightly elevated by reason of, on one hand, the low pressure of the interior unit, and on the other hand the phenomenon of the expansion chamber given by the plenum.

The originality of the technique provided according to the invention resides therefor in its extreme simplicity which permits providing the air conditioning of a building by means of an installation, of which the cost is very much lower than that of current installations.

In a preferred manner, this process has for an object to permit the air conditioning and the heating of buildings and for this purpose, an exterior unit provided with a cycle reversing means is used, and an interior unit provided with an electric battery backup controlled by an exterior thermostat.

Further, according to a preferred embodiment:

for one of the apartment units of the building, called the master unit, there is used a blower grill having air flow characteristics able to permit fluctuations of the flow through said grill with respect to its normal flow, and for the other units of the apartment, called the annex, the ventilating grills provided with control registers for permitting variation of the flow through said grills with respect to their normal flow, over a range such that the ventilating grill of the master unit may absorb the flow variations, and regulating the temperature in the different annex units of the building by modifying, by means of the control registers, the flow of air delivered to said annex units.

According to this preferred embodiment, the regulation of the temperature in one annex unit may be improved in a very simple manner by modifying by means of the control register the flow of heated air in said unit.

In effect, the variation of the flow generated by the closing or opening of one of the blowing grills of one or several annex units is adjusted in the master unit through the blowing grill thereof, which for one part does not include a control register, and on the other part is designed in such a manner as to be able to absorb these flow variations.

It should be noted that the use of such registers is possible due to the fact that one works with low pressure air, which avoids all overpressure at the level of the openings and all bothersome noise, even when the flow through said openings is minimal.

Further, one preferably takes advantage of the operation of the compressor by means of a temperature control member arranged in such a manner as to relieve the air temperature recovered by the ventilation means of the interior unit.

The temperature control member is thus arranged in such a manner as to relieve the air temperature recovered overall which corresponds to the average temperature of the building, and this reacts then to the fluctuations of the flow through the different blowing grills in such a manner as to readjust the temperatures in the building.

Moreover, one preferentially guides the control registers of the blowing grills of the annex units by means of thermostatic control members.

According to another characteristic of the invention, the upper face of the false ceiling is covered by means of a layer of material insulating both phonically and thermally.

Such a material has as its essential function to avoid all condensation resulting from a difference of temperature between the interior of the plenum and the ambient air. It also has the function of attenuating the acoustic level, from the interior unit and from the apartments.

In addition, the interior unit is advantageously integrated in the false ceiling, and one separates said false ceiling into two parts by a baffle forming a return plenum, provided with a return grill able to serve as an inspection door, and the air plenum.

This arrangement of the interior unit in the false ceiling, with placement of a baffle separating this false ceiling into a return plenum and a blowing plenum, constitutes a very advantageous embodiment, for the one part, with respect to the cost of the return installation, and for the other part, from the point of view of maintenance.

The invention extends to an apparatus for air conditioning and/or heating buildings, especially apartment buildings of the type comprising:

an interior unit and an exterior unit connected by fluid connections and electrical connections, the exterior unit comprising ventilation means and an exchanger, and the interior unit comprising ventilation means and an exchanger, means for blowing and return of air connected to the interior unit, a member for controlling the temperature to the interior of the building able to control the operation of the compressor of the exterior unit.

According to the invention, this apparatus is characterized in that:

the interior unit is a low pressure unit able to deliver air under pressure at most equal to 8 mm, the blowing means comprising a false ceiling forming a sealed plenum able to serve as an expansion chamber, said plenum comprising blower grills for each of the units of the building.

BRIEF DESCRIPTION OF THE DRAWINGS

Other characteristics, objects and advantages of the invention will become apparent from the detailed description which follows with reference to the accompanying drawings which show by way of non-limiting example one preferred embodiment. In these drawings, which form an integral part of the present description:

DESCRIPTION OF PREFERRED EMBODIMENTS

Figure 1:
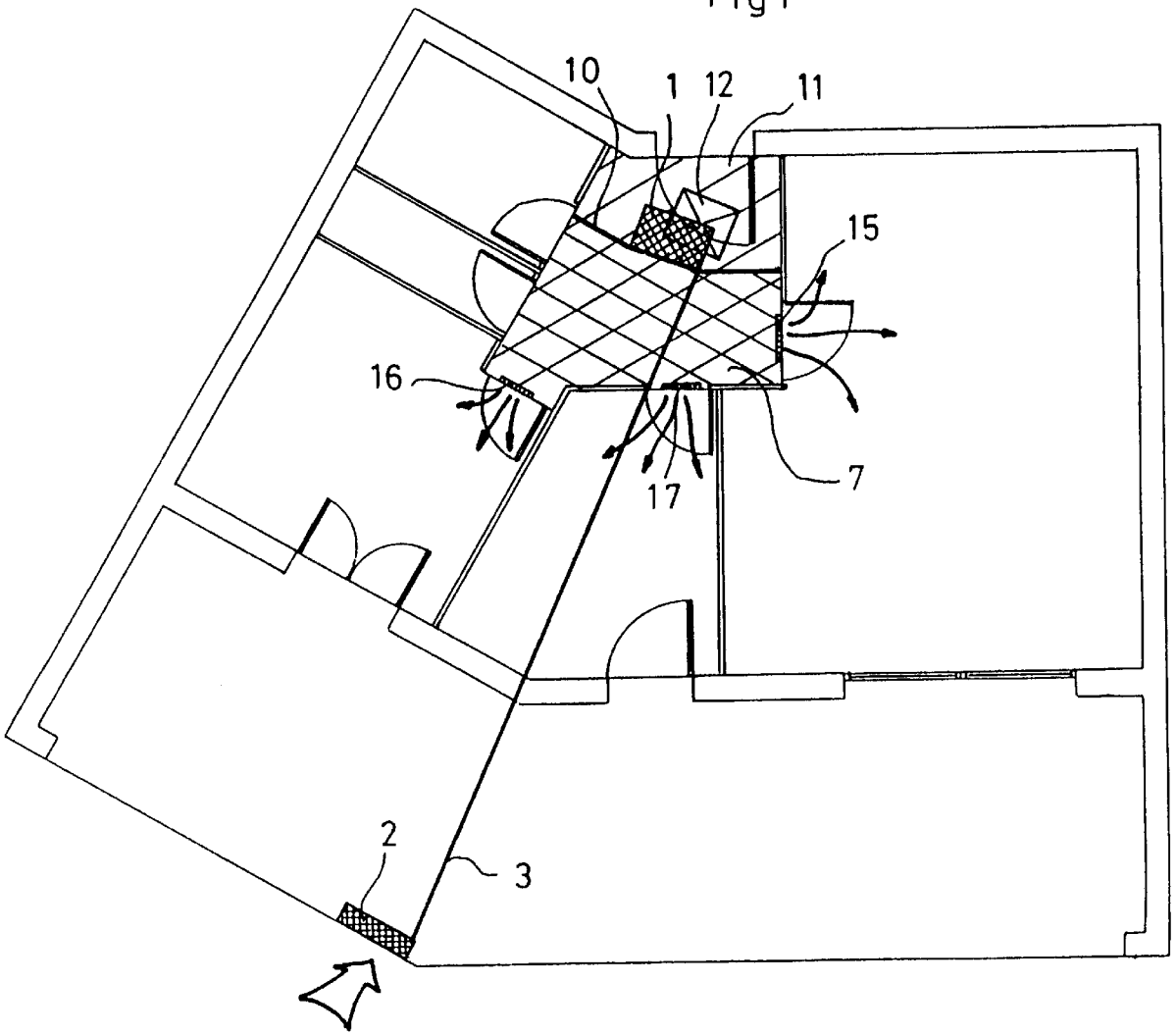
Figure 2:
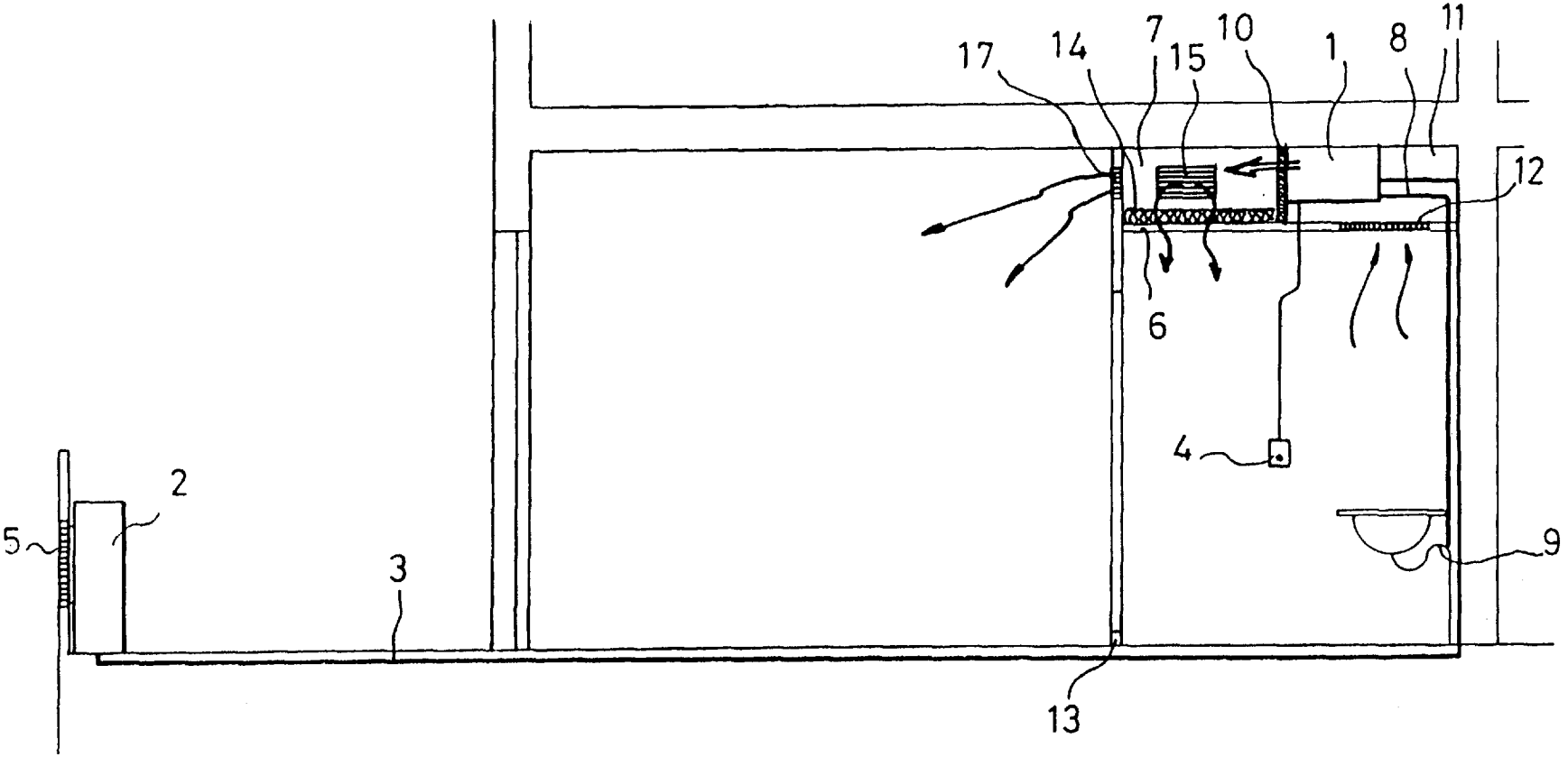

FIG. 1 is a plan view of a building with a yard equipped with an apparatus according to the invention;

FIG. 2 is a schematic elevational view through a vertical plane of this apartment.

The installation according to the invention comprises an interior unit 1 and a direct expansion exterior unit 2 connected together by refrigerant conduits and electric lines such as 3 protected by an ICT and encased in the flooring. The characteristics of these units given hereafter by way of example, correspond to an apartment with a floor area on the order of 50 $m^2$.

The exterior unit 2 comprises a direct expansion heat pump having a refrigerating power of 3600 W and a heating power of 3800 W.

It comprises, conventionally, a sealed compressor equipped with an anti-knock durable housing, a direct expansion exchanger of copper with aluminum fins, a refrigerant circuit and a helicoidal, low speed ventilator. The refrigerant circuit comprises, in addition, essentially, a pressure reduction valve, a four-way cycle inversion valve, an anti-knock liquid bottle, and a dehydrator.

This exterior unit 2 comprises, moreover, a cooling system able to control the temperature on the exchanger and control periodically the inversions of the cycle when the temperature is lower than a predetermined threshold.

The interior unit 1 comprises, itself, a non-specialized ventilo-convector with a nominal flow of 650 $m^3/h$ with a pressure lower than 6 mm and on the order of 5 mm. It comprises a three speed ventilation unit, a direct expansion copper/aluminum exchanger, and an electrical battery of 2 KW. This electric battery is charged by an exterior thermostat which authorizes its engagement below a predetermined control point.

This interior unit 1 is connected to a pre-wired control box comprising a thermostat, arranged in the apartment in such a manner that said thermostat measures the temperature of the air taken in by the unit. This control box 4 comprises further a stop/start button, a fan speed selector, a summer/winter cycle selector.

The refrigerant connections connecting the two units interior 1 and exterior 2 comprise a gas tube and a liquid tube covered with a sleeve of an insulating material.

The electrical connections connecting these two units 1, 2 comprise, themselves, electrical cables delivering power to the interrupter of the exterior unit 2, and permitting delivery to this exterior unit :2 of the control signal of the thermostat.

In one example, the exterior unit 2 is installed on the terrace of an apartment in proximity to the protective housing on this terrace, and comprises an exterior grill 5 integrated into this housing. It should be noted that due to the small size (on the order of 25 cm) of this exterior unit 2, it is easy to conceive of an architectural solution permitting directly integrating it into the housing.

The interior unit 1 is arranged above a false ceiling 6 comprised of a plate of "Placoplatre" BA 13, extending into the traffic areas of the apartment, and adapted to form a blowing plenum 7 permitting distribution of the air to all of the units to be heated or cooled. In order to evacuate condensates, this interior unit 1 is connected to an evacuation conduit 8 connected by a siphon 9 on a waste water pipe.

The volume defined by the false ceiling 6 is furthermore separated into two by vertical baffles 10 arranged along side the interior unit 1, in such a manner as to form two distinct spaces constituting the heating plenum 7 extending to the front of the interior unit 1, and a return plenum 11 extending to the rear of this interior unit 1.

In order to assure the return of air, this false ceiling 6 is provided with a grill 12 arranged to the side of the interior unit 1 in such a manner as to communicate with the return plenum 11. This grill 12, for example secured by means of screws, advantageously has dimensions (for example 600 mm×600 mm) which, due to its positioning to the side of the interior unit 1, permit inspection or the repair of this interior unit.

Further, in order to permit a circulation of air between the apartments to be heated and cooled, and the circulation, the access doors to these units are equipped in such a manner as to provide a light opening 13 on these doors.

It should be noted, finally, concerning this air return, that the control box 4 incorporating the thermostat, is arranged in the circulation, and measures therefor the temperature of the return air through the interior unit 1.

As far as the air distribution is concerned, and in the first place, the false ceiling 6 is covered, in its part defining the heating plenum 7, with a layer 14 of sound and thermal insulating material, such as rock wool.

This air plenum 7 is equally provided with blowing grills for the distribution of air to the different units:

the blowing grill 15 feeding the principal or master unit, generally the dayroom, having airflow characteristics able to permit variations of the flow of said grill plus or minus 40% with respect to its nominal flow, blowing grills 16, 17 feeding the other units is provided with control registers or dampers able to vary of the flow through said grills plus or minus 30% with respect to their nominal flow.

Further, the control registers of the heating grills 16, 17 are controlled by a thermostatic control member (not shown) permitting regulating the temperature of these other units in an independent manner.

What is claimed is:

1. A process for the air conditioning and/or heating of apartments units, particularly in apartment buildings, comprising:

providing an external unit (2) and an internal unit (1) connected by fluid and electrical connections (3), the external unit (2) comprising a compressor, ventilation means and a heat exchanger, the internal unit (1) being of the low-pressure type and comprising ventilation means and a heat exchanger, providing air circulation within the apartment by means of said ventilation means of the interior unit (1), regulating the operation of the external unit (2) by a temperature controlling device (4) within the apartment, whereby said temperature controlling device determines a set temperature, delivering low pressure air into a false ceiling (6) comprising a sealed plenum (7) able to serve as an expansion chamber, said sealed plenum including for one of the rooms of the apartment a first air delivery grill (15) without a control damper and having characteristics capable of bringing about fluctuations in the output of said grating with respect to the nominal output thereof, and said sealed plenum including for the other rooms of the apartment air second delivery grills (16, 17) having control dampers enabling variation of the output of said grills with respect to their nominal output within a range such that said first air delivery grill can absorb said variations in output, regulating the temperature in each of said other rooms by modifying the output of air delivered into said other rooms through said second delivery grills, and absorbing the output fluctuations by deflecting said fluctuations into said one of the rooms through said first delivery grill in response to variations in output of said second delivery grills.

2. A process as in claim 1 and wherein said external unit (2) includes cycle-inverting means, and said internal unit includes an electrical battery and an external thermostat control.

3. A process as in claim 1 and wherein said internal unit (1) and said external unit (2) include direct expansion heat exchangers.

4. A process as in claim 1 and wherein the adjustable dampers of said second air delivery gratings (16, 17) are thermostatically controlled.

5. A process as in claim 1 and wherein said false ceiling includes a layer of sound and thermal insulation.

6. A process as in claim 1 and wherein said internal unit (1) is integrated into said false ceiling (6), and said false ceiling includes a lateral wall (10) dividing said sealed plenum (7) into an intake plenum (11) having an intake grating (12) and an air delivery plenum.

7. A system for air conditioning and/or heating of apartments particularly in apartment buildings, comprising:

an internal unit (1) of the low-pressure type and an external unit (2) connected by means of fluid and electrical lines (3), said external unit (2) comprising a compressor, ventilating means and a heat exchanger, and said internal unit (1) comprising ventilating means and a heat exchanger, means for the delivery and intake of air and associated with said internal unit (1), a device (4) capable of regulating the operation of said external unit (2) for controlling the temperature within the apartment, said air delivery and intake means comprising a false ceiling (6) forming a sealed plenum (7) serving as an expansion chamber and including a first air delivery grill for one master room of the apartment and a second air delivery grill in each of the other of the rooms of the apartment, said first air delivery grill (15) having characteristics enabling the output of said first grill to vary from the nominal output thereof and delivering air to said master room, said second air delivery grills (16, 17) enabling output to the other of said rooms and having adjustable dampers for varying the output of said second air delivery grills within a range such that said first air delivery grill (15) of said master room is capable of absorbing the output variations of said second air delivery grills in response to variations in output of said second delivery grills.

8. A system for air-conditioning and heating as in claim 7 and wherein said external unit (2) includes cycle inverting means and said internal unit (1) includes an electrical battery and is controlled by an external thermostat.

9. A system for air-conditioning and heating as in claim 7 and wherein said internal unit (1) and said external unit (2) are subject to direct expansion.

10. A system for air-conditioning and heating as in claim 7 and wherein each of said second air-delivery grills (16, 17) comprises an adjustable damper and a thermostatic control for controlling said damper.

11. A system for air-conditioning and heating as in claim 7 and wherein said false ceiling (6) includes a layer of sound and thermal insulating material therein.

* * * * *